US011963600B2

(12) United States Patent
Chung et al.

(10) Patent No.: US 11,963,600 B2
(45) Date of Patent: Apr. 23, 2024

(54) COSMETIC CONTAINER HAVING WIPER CAPABLE OF REMOVING COSMETIC LIQUID FROM APPLICATION SUPPORT ROD HAVING NON-CIRCULAR CROSS-SECTIONAL AREA

(71) Applicant: CTK CO., LTD., Seoul (KR)

(72) Inventors: In Yong Chung, Seoul (KR); Sun Young Choi, Seoul (KR); Won Eui Lee, Seoul (KR); In Young Um, Seoul (KR); Kyung Ho Kang, Suwon-si (KR)

(73) Assignee: CTK CO., LTD, Seoul (KR)

( * ) Notice: Subject to any disclaimer, the term of this patent is extended or adjusted under 35 U.S.C. 154(b) by 0 days.

(21) Appl. No.: 18/030,420

(22) PCT Filed: Nov. 10, 2020

(86) PCT No.: PCT/KR2020/015665
§ 371 (c)(1),
(2) Date: Apr. 5, 2023

(87) PCT Pub. No.: WO2022/080557
PCT Pub. Date: Apr. 21, 2022

(65) Prior Publication Data

US 2023/0309679 A1 Oct. 5, 2023

(30) Foreign Application Priority Data

Oct. 12, 2020 (KR) ..... 10-2020-0131240

(51) Int. Cl.
*A46B 11/00* (2006.01)
*A45D 34/04* (2006.01)
*A45D 40/26* (2006.01)

(52) U.S. Cl.
CPC ..... *A45D 34/04* (2013.01); *A45D 40/265* (2013.01); *A45D 40/267* (2013.01); *A46B 2200/1053* (2013.01)

(58) Field of Classification Search
CPC ..... A45D 40/265; A45D 40/267; A46B 2200/1053
(Continued)

(56) References Cited

U.S. PATENT DOCUMENTS 6,502,584 B1 * 1/2003 Fordham ..... A46B 3/18 401/122
7,452,151 B2 * 11/2008 Rousselet ..... A45D 40/267 401/122
(Continued)

FOREIGN PATENT DOCUMENTS

FR 2992531 A1 * 1/2014 ..... A45D 40/267
JP 2008125843 A 6/2008
(Continued)

*Primary Examiner* — Jennifer C Chiang
(74) *Attorney, Agent, or Firm* — PARK LAW FIRM

(57) ABSTRACT

A cosmetic container having a wiper capable of removing a cosmetic liquid from an application support rod having a non-circular cross-sectional area is proposed. The cosmetic container includes a container (110) in which the cosmetic liquid is accommodated, a container cap (120) opened/closed with respect to an injection port (112) of the container (110), and an application part (130) rotatably fitted and coupled to the container cap. The wiper (140) is coupled to an inner side of the injection port (112) of the container, a through-hole (144) of the cleaner part (142) is formed in a circular shape, the application part includes an application support rod (132) and an application member (134), an airtight recessed groove (133) is formed on an upper portion of the application support rod, and the application support
(Continued)

rod extended from a lower portion of the airtight recessed groove has a non-circular cross-sectional area.

11 Claims, 8 Drawing Sheets

(58) Field of Classification Search
USPC ..... 401/126
See application file for complete search history.

(56) References Cited

U.S. PATENT DOCUMENTS

| | | | | |
|---|---|---|---|---|
| 8,191,559 | B2 * | 6/2012 | Bickford | A45D 34/045 132/218 |
| 11,457,718 | B2 * | 10/2022 | Garrison | A45D 34/043 |
| 2011/0299910 | A1 * | 12/2011 | Crutchley | B29C 45/0081 401/122 |
| 2014/0147189 | A1 * | 5/2014 | Wightman | A45D 34/046 401/122 |

FOREIGN PATENT DOCUMENTS

| | | | |
|---|---|---|---|
| KR | 1020130012946 | A | 9/2012 |
| KR | 1020130014649 | A | 2/2013 |
| KR | 2020150003074 | U | 8/2015 |
| KR | 1020170033031 | A | 9/2015 |
| KR | 200479284 | Y1 | 1/2016 |
| KR | 1020180081919 | A | 7/2018 |
| KR | 102119428 | B1 | 6/2020 |

* cited by examiner

[Fig. 1]
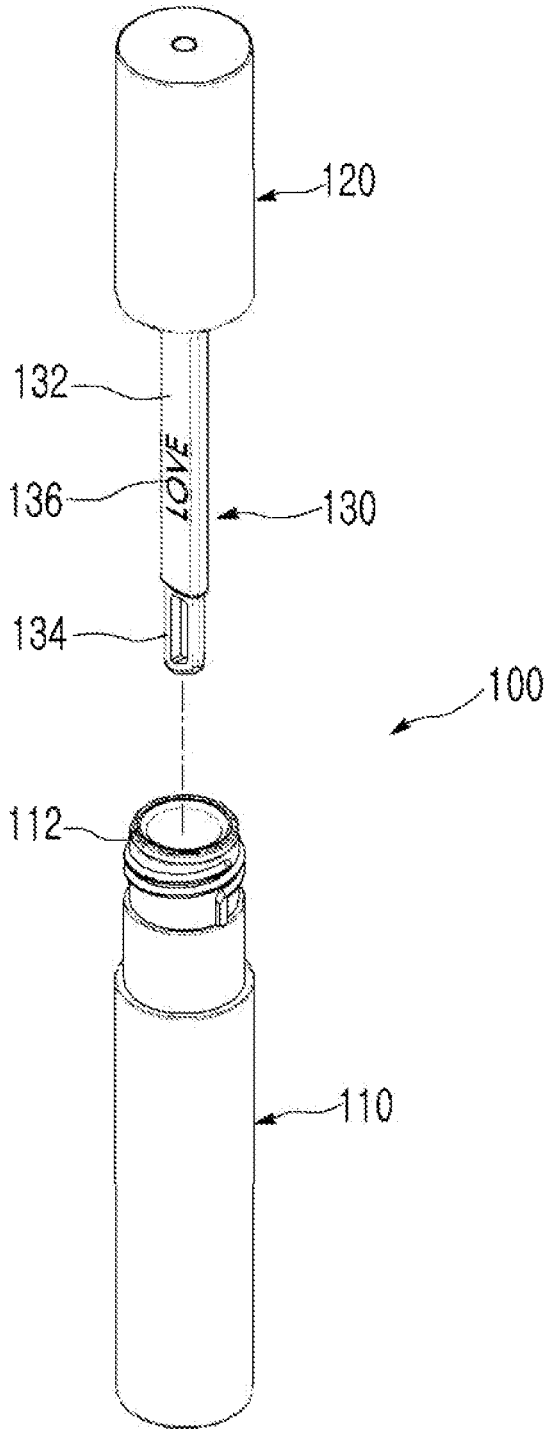

[Fig. 2]
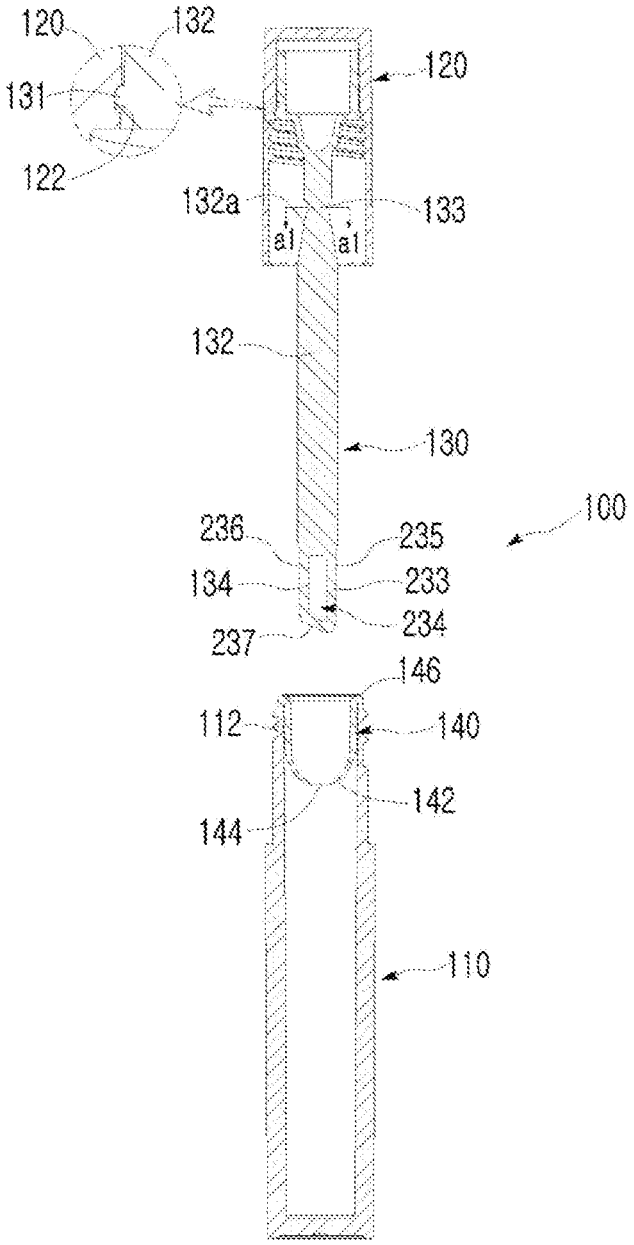

[Fig. 3]
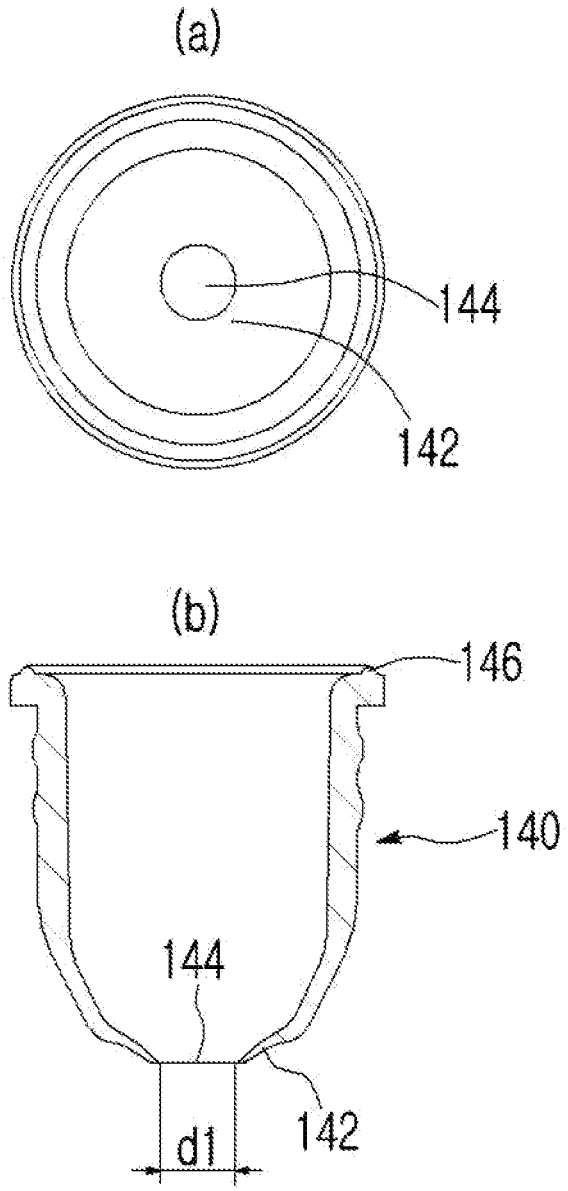

[Fig. 4]
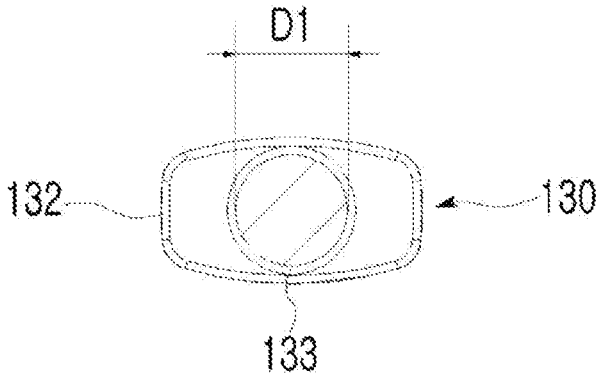
[Fig. 5]
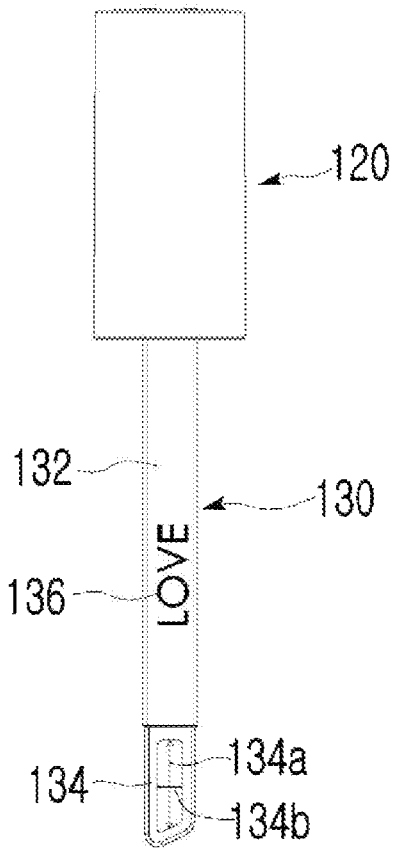

[Fig. 6]
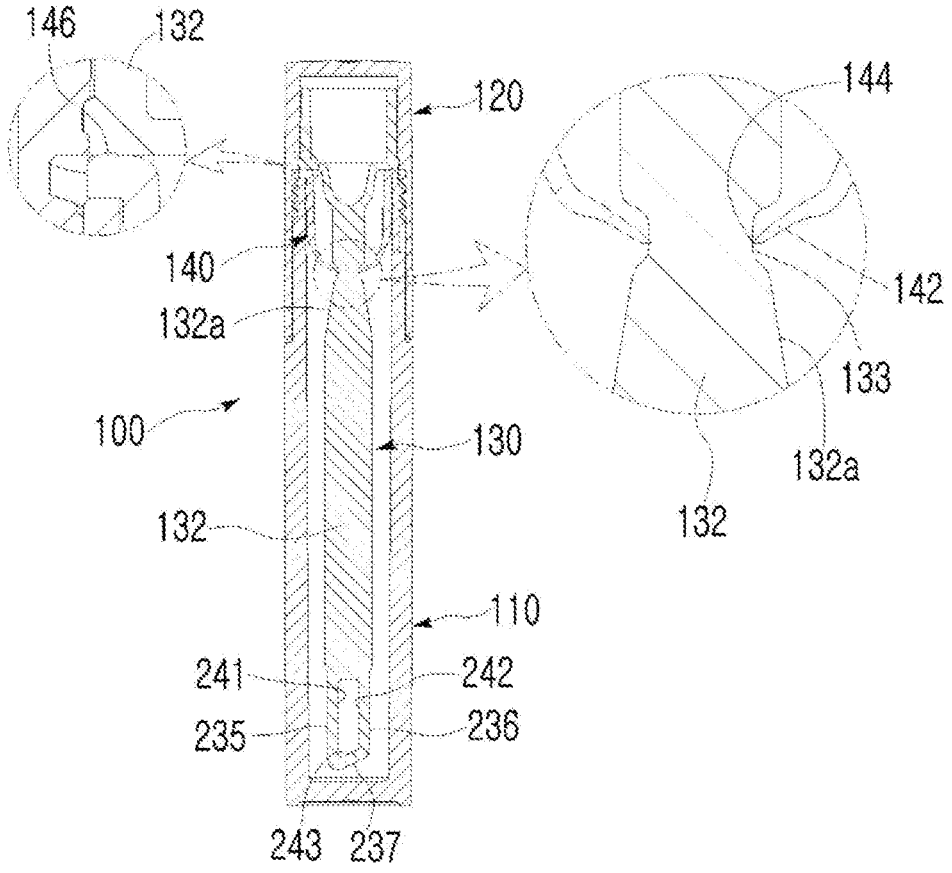

[Fig. 7]
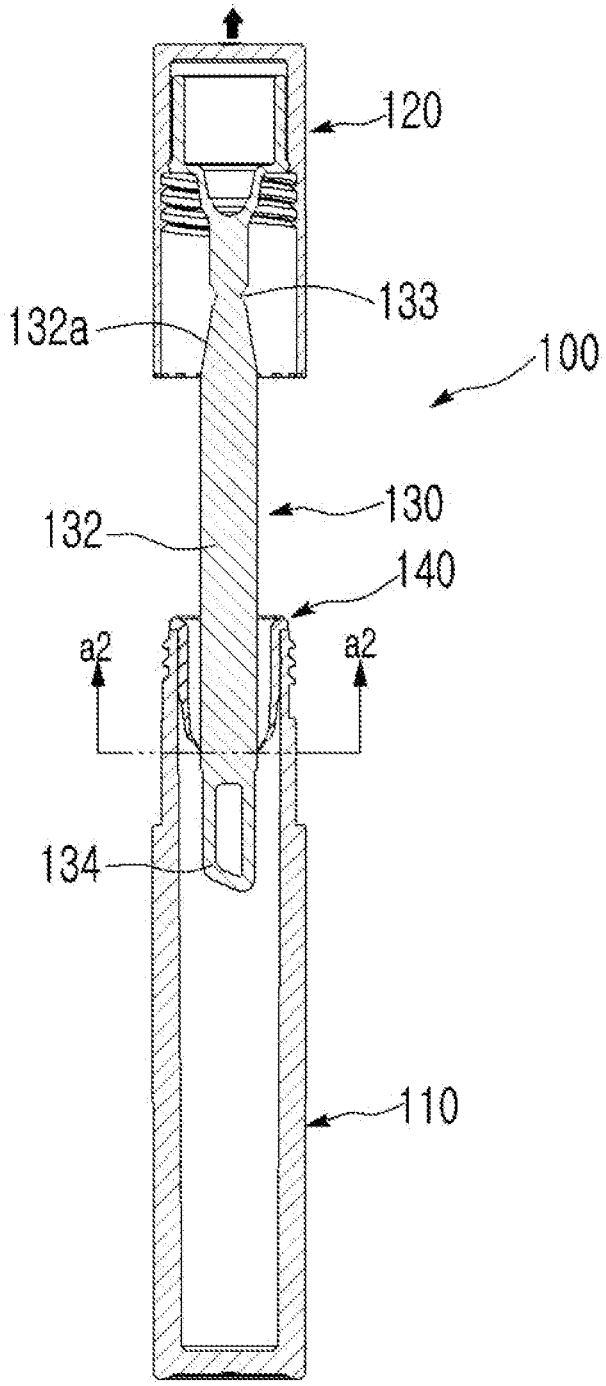

[Fig. 8]
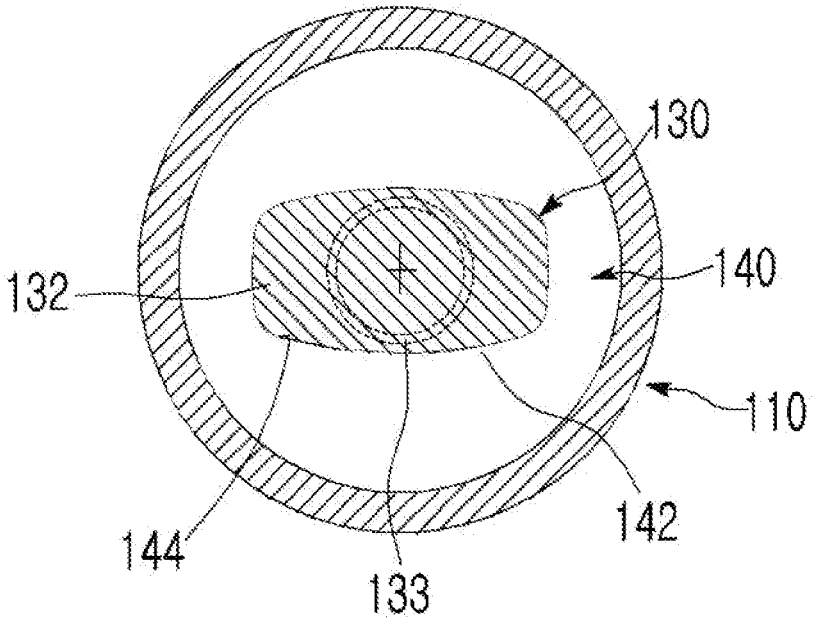

[Fig. 9]
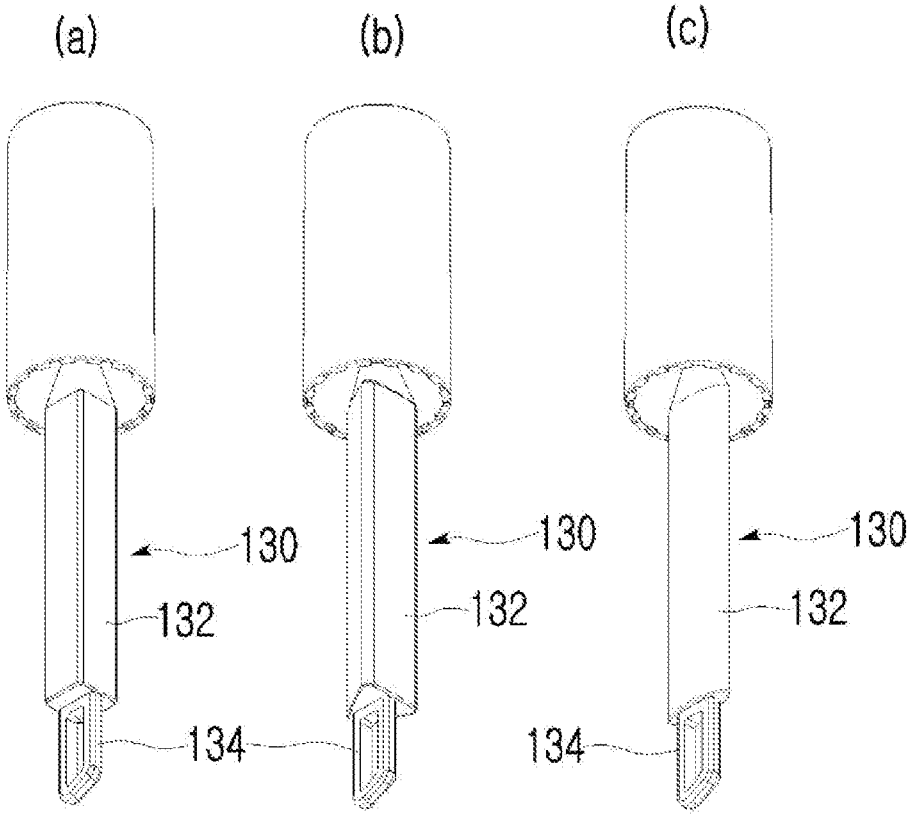

COSMETIC CONTAINER HAVING WIPER CAPABLE OF REMOVING COSMETIC LIQUID FROM APPLICATION SUPPORT ROD HAVING NON-CIRCULAR CROSS-SECTIONAL AREA

TECHNICAL FIELD

The present disclosure relates to a cosmetic container that can be used for purposes such as storing lip gloss or mascara depending on the shape of an application member. More particularly, the present disclosure relates to a cosmetic container having a wiper capable of removing a cosmetic liquid from an application support rod having a non-circular cross-sectional area, the container allowing the rotatable opening/closing of a container cap to be easily achieved while wiping off a cosmetic liquid remaining on the outer peripheral surface of an application support rod having a non-circular cross-sectional area or wiping off the cosmetic liquid so as to leave the proper amount of the cosmetic liquid on an application member, allowing the cosmetic liquid to permeate an engraved pattern part formed on the outer peripheral surface of the application support rod, so that an advertising effect for a product is provided, and allowing the application support rod to have cross-sectional areas of various shapes so that the design properties of the product are remarkably increased and, simultaneously, various visual effects can be provided.

BACKGROUND ART

Generally, a cosmetic container used for applying makeup such as lip gloss or mascara includes a container which contains contents, i.e., a cosmetic liquid, and an application support rod which is equipped with an application member depending on the makeup application and is detachably coupled to the container along with a container cap, and the cosmetic liquid contained in the container is applied to the application member during makeup. However, when the cosmetic container includes only the container and the container cap equipped with the application support rod, it is difficult to apply a proper amount of cosmetic liquid to the application member provided on the application support rod. Further, there is a problem in that the cosmetic liquid is applied to even the application support rod. In order to solve the problem, a separate wiper is installed in an opening of the container to remove the cosmetic liquid from the application member as well as the application support rod when the container cap is opened or closed, or to apply a proper amount of cosmetic liquid.

However, the conventional cosmetic container equipped with the wiper is configured such that the application support rod is rotated together when the container cap opens or closes an injection port in the container and is detachably coupled while passing through the wiper, and the cosmetic liquid applied to the outer peripheral surface or the application member is appropriately wiped off when the application support rod passes through the wiper. Thus, due to the structure of the wiper, the cross-sectional area of the application support rod should always have a circular shape. In the case of the application support rod having a non-circular cross-sectional area, it is impossible to remove the cosmetic liquid. Thus, during makeup, there is a structural limitation that the shape of the application support rod, which is highly visible to a makeup artist, is very simple and inevitably limited. In particular, as the shape of the application support rod is limited to only a circular shape, it is difficult to provide various design properties to a product. Since the application support rod of the conventional cosmetic container has no other functions other than the simple functions of fixing the application member and allowing the application member to enter deep into the container, it is also difficult to solve visual simplicity.

DOCUMENTS OF RELATED ART

Patent Document

1. KR 1020130012946 A (Feb. 5, 2013)
2. KR 102119428 B1 (Jun. 1, 2020)

DISCLOSURE

Technical Problem

The present disclosure has been made to solve the above-mentioned problems and difficulties, and an objective of the present disclosure provides a cosmetic container that can be used for purposes such as lip gloss or mascara depending on the shape of an application member, i.e., a cosmetic container having a wiper capable of removing a cosmetic liquid from an application support rod having a non-circular cross-sectional area, the container allowing the rotatable opening/closing of a container cap to be easily achieved while wiping off a cosmetic liquid remaining on the outer peripheral surface of an application support rod having various non-circular cross-sectional areas or wiping off the cosmetic liquid so as to leave the proper amount of the cosmetic liquid on an application member using a cleaner part of the wiper having elasticity, allowing the cosmetic liquid to permeate an engraved pattern part formed on the outer peripheral surface of the application support rod, so that an advertising effect for a product is provided, and allowing the application support rod to have cross-sectional areas of various shapes so that the design properties of the product are remarkably increased and, simultaneously, various visual effects can be provided.

Technical Solution

In order to accomplish the above objective, the present disclosure provides a cosmetic container having a wiper capable of removing a cosmetic liquid from an application support rod having a non-circular cross-sectional area, the cosmetic container including a container in which the cosmetic liquid is accommodated, a container cap opened/closed with respect to an injection port of the container, and an application part rotatably fitted and coupled to the container cap, wherein the wiper, which is made of elastic rubber and has a cleaner part with a shape that narrows so as to be curved toward a lower end thereof, is coupled to an inner side of the injection port of the container, a through-hole of the cleaner part is formed in a circular shape, the application part includes an application support rod and an application member, which is provided on an end of the application support rod, an airtight recessed groove, which has a circular cross-sectional area and to which the cleaner part of the wiper is closely fastened when the container cap is coupled, is formed at an upper portion of the application support rod, and the application support rod extended from a lower portion of the airtight recessed groove has a non-circular cross-sectional area.

According to the present disclosure, the application support rod may include an inclined guide surface formed on the lower portion of the airtight recessed groove.

According to the present disclosure, the cleaner part of the wiper may be formed to gradually become thinner toward an end in which the through-hole is formed to easily perform expand and wipe the application support rod having a non-circular cross-sectional area of the application part.

According to the present disclosure, when the container cap closes on the container, an inner diameter d1 of the through-hole of the cleaner part which is in contact with and is supported on a circular catch recessed groove formed in the application support rod of the application part may be formed to have a size equal to or smaller than an outer diameter D1 of the catch recessed groove, thus providing a strong contact force with the catch recessed groove.

According to the present disclosure, an airtight rim may be further formed on an open upper surface of the wiper to protrude therefrom, so that a corresponding lower surface of the application support rod may be in elastic contact therewith when the container cap is coupled, thus preventing cosmetic liquid remaining in the wiper from leaking to the outside.

According to the present disclosure, an engraved pattern part may be further formed on the outer peripheral surface of the application support rod for an advertisement due to penetration of the cosmetic liquid.

Advantageous Effects

According to the present disclosure, because a close-fitting expansion part of a wiper has elasticity, it can evenly contact the outer peripheral surface of an application support rod having a cross-sectional area different from a circular cross-sectional area even if the inner peripheral surface of the expansion part has a circular shape, thus stably removing a cosmetic liquid from an application member as well as the outer peripheral surface of the application support rod passing through a cleaner part, and allowing a proper compression control. Further, as a container cap is detachably coupled to a container while being rotatable around the application support rod, the container cap can be easily detached from and coupled to the container even if the application support rod is forcibly tightened to the cleaner part of the wiper. Further, because the application support rod is in elastic contact with and is supported by the cleaner part of the wiper having elasticity even if the application support rod is formed to have a non-circular cross-sectional area, it is possible to provide the application support rod having the non-circular cross-sectional area, and thereby it is possible to provide various design properties of the application support rod.

Further, the present disclosure is advantageous in that a cosmetic liquid penetrates and remains in an engraved pattern part formed on the outer peripheral surface of an application support rod while passing through a wiper, thus providing an advertising effect, thereby remarkably enhancing the visibility of a product, and further enhancing the overall quality of the product.

DESCRIPTION OF DRAWINGS

FIG. 1 is an exploded perspective view of the present disclosure.

FIG. 2 is an exploded sectional view of the present disclosure.

FIGS. 3(*a*) and 3(*b*) are a plan view and a front sectional view of a wiper according to the present disclosure.

FIG. 4 is an enlarged sectional view taken along line a1-a1 of FIG. 2.

FIG. 5 is a front view of a container cap having an engraved pattern part formed on a surface of an application support rod according to the present disclosure.

FIG. 6 is a sectional view illustrating a state in which the container cap is coupled to a container according to the present disclosure.

FIG. 7 is a side sectional view illustrating an open operation state in which an application part is ejected through the open operation of the container cap according to the present disclosure.

FIG. 8 is an enlarged sectional view taken along line a2-a2 of FIG. 7.

FIGS. 9(*a*), 9(*b*), and 9(*c*) are diagrams illustrating respective shape examples of application support rods having non-circular cross-sectional areas according to the present disclosure.

BEST MODE

Hereinafter, a preferred embodiment of the present disclosure will be described in detail with reference to the accompanying drawings.

Referring to FIGS. 1 to 8, a cosmetic container 100 having a wiper capable of removing a cosmetic liquid from an application support rod having a non-circular cross-sectional area according to the present disclosure includes a container 110 in which the cosmetic liquid is accommodated, a container cap 120 opened and closed with respect to an injection port 112 of the container 110, and an application part 130 rotatably fitted and coupled to the container cap 120. The wiper 140, which is made of elastic rubber and has a cleaner part 142 with a shape that narrows so as to be curved toward a lower end thereof, is coupled to an inner side of the injection port 112 of the container, a through-hole 144 of the cleaner part 142 is formed in a circular shape, the application part 130 includes an application support rod 132 and an application member 134, which is provided on an end of the application support rod, an airtight recessed groove 133, which has a circular cross-sectional area and to which the cleaner part 142 of the wiper 140 is closely fastened when the container cap 120 is coupled, is formed at an upper portion of the application support rod 132, and the application support rod 132 extended from a lower portion of the airtight recessed groove 133 has a non-circular cross-sectional area.

According to the present disclosure, the application support rod 132 may further include an inclined guide surface 132*a* on the lower portion of the airtight recessed groove 133.

The inclined guide surface 132*a* is formed to narrow toward the airtight recessed groove 133, thus gradually expanding the cleaner part 142 of the wiper 140 when the application support rod 132 having the non-circular cross-sectional area is ejected, and thereby allowing the wiping of the application support rod 132 to be more stably achieved.

The application part 130 is rotatably fitted and coupled to the container cap 120 by fitting a locking ring 131 which protrudes from the upper outer peripheral surface of the application support rod 132 into a locking groove 122 formed on the inner peripheral surface of the container cap.

Therefore, the container cap 120 and the application support rod 130 may be separately rotated when the container cap 120 is manipulated to open or close the container 110. In addition, such a coupling structure allows the container cap 120 to open or close an opening 112 of the container 110 through a screw rotating method without rotational interference with the application support rod 132.

Further, according to the present disclosure, the application member 134 provided on the application support rod 132 may be used in combination with an application member of a proper shape according to cosmetic purposes such as lip gloss or mascara. As shown in Figs, the application member 134, as shown, has an elongated shape 233 and an opening 234, and thickness of the application member 134 is less than (thinner than) the thickness of the application support rod 132. The elongated shape of the application member 134 is formed by a first direction 134*a* of the application member 134 is longer than a second direction 134*b* of the application member 134. The application member 134 has a first side 235, a second side 236, and a third side 237. The first side 235 is longer than the second side 236; thus, the third side 237 has a slope by connecting between the first side 235 and the second side 236. The application member 134 also has a first wall 241 opposing the first side 235, a second wall 242 opposing the second side 236, and a third wall 243 opposing the third side 237, wherein a thickness between the first side 235 and the first wall 241, the thickness between the second side 236 and the second wall 242, and the thickness between the third side 236 and the third wall 243 are the same.

According to the present disclosure, the cleaner part 142 of the wiper 140 is formed to gradually become thin toward an end in which the through-hole 144 is formed, thus allowing the application support rod 132 of the application part 130 having the non-circular cross-sectional area to be easily expanded and wiped.

Since the section of the cleaner part 142 of the wiper 140 is formed to gradually become thin toward the end in which the through-hole 144 is formed, it stably contacts the catch recessed groove 133 of the application support rod 132 having the circular cross-sectional area, and it is possible to provide active elastic force to the outer peripheral surface of the application support rod 132 having the non-circular cross-sectional area, when the container cap 120 is opened or closed. Thereby, the cosmetic liquid may be easily wiped off from the outer peripheral surface of the application support rod.

The wiper 140 having the cleaner part 142 for providing stable elastic force to the application support rod 132 of the application part 130 may be made of various elastic rubber materials such as silicone rubber or NBR rubber.

In addition, in order to prevent unexpected removal when the wiper 140 is mounted inside the injection port 112 of the container 110, the wiper may be tightly coupled to the injection portion through various methods such as undercut assembly.

According to the present disclosure, when the container cap 120 closes the container 110, the through-hole 144 of the cleaner part 142 that is closely supported on the circular catch recessed groove 133 formed on the application support rod 132 of the application part 130 is formed such that the inner diameter d1 is equal to or smaller than the outer diameter D1 of the catch recessed groove 133. Thus, it is preferable to provide stable contact force to the catch recessed groove.

Further, according to the present disclosure, in the application part 130, the application support rod 132 formed on the lower end of the catch recessed groove 133 having the circular cross-sectional area to have the non-circular cross-sectional area may be formed to have various non-circular cross-sectional areas such as rectangular, triangular, and elliptical cross-sectional areas as illustrated in FIGS. 9(*a*), 9(*b*), and 9(*c*).

According to the present disclosure, an airtight rim 146 may be further formed on an open upper surface of the wiper 140 to protrude therefrom, so that a corresponding lower surface of the application support rod 132 is in elastic contact therewith when the container cap 120 is coupled, thus preventing the cosmetic liquid remaining in the wiper 140 from leaking to the outside.

Further, according to the present disclosure, an engraved pattern part 136 may be further formed on the outer peripheral surface of the application support rod 132 having the non-circular cross-sectional area for an advertisement due to penetration of the cosmetic liquid.

Since the engraved pattern part 136 is shaped to be engraved to a predetermined depth with respect to the surface of the application support rod 132, the cosmetic liquid on the surface of the application support rod may penetrate therein while being wiped off by the cleaner part 142 of the wiper 140. Further, the cosmetic liquid may remain without being removed even when the application support rod 132 is manipulated to be ejected, thus allowing an engraved pattern to be visually seen during makeup.

Since the pattern may be always displayed to the outside unless it is intentionally removed as the cosmetic liquid penetrates into the engraved pattern part, the engraved pattern part 136 functions to provide a decorative beauty, and also enables various color expressions depending on the color of the cosmetic liquid, thus allowing consumers to have more fun with makeup.

The engraved pattern part 136 may be displayed in various manners. For example, characters, company logos, product names, pictures, figures, marks and the like may be engraved in various manners.

As described above, the cosmetic container 100 having the wiper capable of removing the cosmetic liquid from the application support rod having the non-circular cross-sectional area according to the present disclosure, is configured as follows: in a state where the container cap 120 closes the container 110, the catch recessed groove 133 having the circular cross-sectional area, which is formed on the upper portion of the application support rod 132 of the application part 130 fitted into the container 110 through the circular through-hole 144 formed through the cleaner part 142 of the wiper 140 made of the elastic rubber material, is elastic contact and supported therewith, thus allowing airtight sealing operation to be stably performed. Further, when the container cap 120 is rotated to be opened and then pulled out to put on makeup, the application part 130 is simultaneously pulled out. In this process, the cleaner part 142 of the wiper 140 is released from the catch recessed groove 133 having the circular cross-sectional area. Simultaneously, the cleaner part is in elastic contact with the outer peripheral surface of the application support rod 132 having the non-circular cross-sectional area, which is formed on the lower end of the catch recessed groove, by an elastic force, wipes off the cosmetic liquid from the outer peripheral surface of the application support rod, and appropriately removes an excessive amount of cosmetic liquid from the application member 134.

In addition, when the container cap 120 opens the container 110, the application support rod 132 of the application part 130 is in elastic contact with the cleaner part 142 of the wiper 140. As only the container cap is rotated separately from the application part 130 to be opened, the application support rod 132 having the non-circular cross-sectional area may be ejected while being in close contact with the cleaner part such that the outer peripheral surface of the application support rod is stably surrounded by the cleaner part 142 due to the elastic force, even if the through-hole 144 formed in the cleaner part of the wiper has a circular shape.

Therefore, even if the application support rod 132 of the application part 130 has the non-circular cross-sectional area, the cosmetic liquid may be easily removed by the cleaner part 142 of the wiper 140 having the circular through-hole 144. As the cosmetic liquid is properly wiped, it is possible to stably prevent the waste or excessive use of the cosmetic liquid.

Further, it is possible to provide a more fun and splendid appearance through the configuration of the engraved pattern part 136 formed on the application support rod 132, thus giving a user the fun of makeup.

Although the present disclosure was described with reference to specific embodiments shown in the drawings, it is apparent to those skilled in the art that the present disclosure may be changed and modified in various ways without departing from the scope of the present disclosure, which is described in the following claims.

The invention claimed is:

1. A cosmetic container having a wiper capable of removing a cosmetic liquid from an application support rod having a non-circular cross-sectional area, the cosmetic container comprising a container (110) in which the cosmetic liquid is accommodated; a container cap (120) opened/closed with respect to an injection port (112) of the container (110); and an application part (130) rotatably fitted and coupled to the container cap (120), wherein the wiper (140), which is made of elastic rubber and has a cleaner part (142) with a shape that narrows so as to be curved toward a lower end thereof, is coupled to an inner side of the injection port (112) of the container, a through-hole (144) of the cleaner part (142) is formed in a circular shape, the application part (130) includes an application support rod (132) and an application member (134), which is provided on an end of the application support rod, an airtight recessed groove (133), which has a circular cross-sectional area and to which the cleaner part (142) of the wiper (140) is closely fastened when the container cap (120) is coupled, is formed at an upper portion of the application support rod (132), and the application support rod (132) extended from a lower portion of the airtight recessed groove (133) has a non-circular cross-sectional area, wherein the application member (134) has an opening (234), wherein the opening (234) of the application member (134) has an elongated shape wherein a first direction (134*a*) is longer than a second direction (134*b*), wherein a thickness of the application member (134) is thinner than a thickness of the application support rod (132), and wherein the application member (134) has a first side (235), a second side (236), and a third side (237), wherein the second side (236) is shorter than the first side (235), and wherein the third side (237) has a slope formed by connecting between the first side (235) and the second side (236).

2. The cosmetic container of claim 1, wherein the application member (134) also has a first wall (241) opposing the first side (235), a second wall (242) opposing the second side (236), and a third wall (243) opposing the third side (237), and wherein a thickness between the first side (235) and the first wall (241), and the thickness between the second side (236) and the second wall (242) are the same.

3. The cosmetic container of claim 2, wherein the thickness between the first side (235) and the first wall (241), the thickness between the second side (236) and the second wall (242), and the thickness between the third side (236) and the third wall (243) are the same.

4. The cosmetic container of claim 3, wherein the application support rod (132) comprises an inclined guide surface (132*a*) formed on the lower portion of the airtight recessed groove (133).

5. The cosmetic container of claim 3, wherein the cleaner part (142) of the wiper (140) is formed to gradually become thinner toward an end in which the through-hole (144) is formed to easily perform expand and wipe the application support rod (132) having a non-circular cross-sectional area of the application part (130).

6. The cosmetic container of claim 3, wherein, when the container cap (120) closes on the container (110), an inner diameter (d1) of the through-hole (144) of the cleaner part (142) which is in contact with and is supported on a circular catch recessed groove (133) formed in the application support rod (132) of the application part (130) is formed to have a size equal to or smaller than an outer diameter (D1) of the catch recessed groove (133), thus providing a stable contact force with the catch recessed groove.

7. Cosmetic container of claim 3, wherein an airtight rim (146) is further formed on an open upper surface of the wiper (140) to protrude therefrom, so that a corresponding lower surface of the application support rod (132) is in elastic contact therewith when the container cap (120) is coupled, thus preventing cosmetic liquid remaining in the wiper (140) from leaking to the outside.

8. The cosmetic container of claim 3, wherein an engraved pattern part (136) is further formed on the outer peripheral surface of the application support rod (132) having the non-circular cross-sectional area for an advertisement due to penetration of the cosmetic liquid.

9. The cosmetic container of claim 1 the application member (134) also has a first wall opposing the first side, a second wall opposing the second side, and a third wall opposing the third side, wherein a thickness of the first side, a thickness of the second side, and a thickness of the third side are the same.

10. The cosmetic container of claim 9, wherein the cleaner part (142) of the wiper (140) is formed to gradually become thinner toward an end in which the through-hole (144) is formed to easily perform expand and wipe the application support rod (132) having a non-circular cross-sectional area of the application part (130).

11. The cosmetic container of claim 10, wherein, when the container cap (120) closes on the container (110), an inner diameter (d1) of the through-hole (144) of the cleaner part (142) which is in contact with and is supported on a circular catch recessed groove (133) formed in the application support rod (132) of the application part (130) is formed to have a size equal to or smaller than an outer diameter (D1) of the catch recessed groove (133), thus providing a stable contact force with the catch recessed groove, and wherein an airtight rim (146) is further formed on an open upper surface of the wiper (140) to protrude therefrom, so that a corresponding lower surface of the application support rod (132) is in elastic contact therewith when the container cap (120) is coupled, thus preventing cosmetic liquid remaining in the wiper (140) from leaking to the outside.

* * * * *